United States Patent [19]

Chilcoate

[11] Patent Number: 4,790,118

[45] Date of Patent: Dec. 13, 1988

[54] MEDICATION PACKAGING AND DISPENSING SYSTEM

[75] Inventor: Elmer F. Chilcoate, Plainfield, Ind.

[73] Assignee: Econodose, Inc., Indianapolis, Ind.

[21] Appl. No.: 37,631

[22] Filed: Apr. 13, 1987

[51] Int. Cl.[4] ..... B65B 61/02; B65B 5/04; B65B 5/06

[52] U.S. Cl. ..... 53/411; 53/451; 53/131; 53/244; 53/554

[58] Field of Search ..... 53/244, 554, 411, 131, 53/451, 469; 221/263, 265

[56] References Cited

U.S. PATENT DOCUMENTS

| | | | |
|---|---|---|---|
| 719,939 | 2/1903 | Gwinn et al. | 221/263 |
| 2,582,461 | 1/1952 | Schneider | 221/265 |
| 2,742,184 | 4/1956 | Yerkes et al. | 221/265 |
| 3,068,916 | 12/1962 | Richardson | 221/263 |

FOREIGN PATENT DOCUMENTS

| | | | |
|---|---|---|---|
| 153389 | 9/1953 | Australia | 53/554 |
| 456291 | 3/1947 | Canada | 53/554 |
| 783064 | 7/1935 | France | 53/554 |

OTHER PUBLICATIONS

"Automated Dispensing . . . Patient Specific Unit Dose"-Brochure by Travenol Laboratories, Inc., Deerfield, Ill., 414170, Travenol Laboratories, Inc.-10/85.

*Primary Examiner*—Horace M. Culver

*Attorney, Agent, or Firm*—Woodard, Emhardt, Naughton, Moriarty & McNett

[57] ABSTRACT

A medication packaging and dispensing machine has a solid oral medication feeder bowl mounted near the top and a sizing disk in the feeder bowl to receive the medication units such as capsules or tablets from the bowl and deliver them individually to a drop tube through which they descend to a packaging station. Packing strip material stored in two rolls is pulled into the packaging station by a cooperating pair of rotary pull and seal platens which move the strips around the medication units and seal the strips together perimetrically around each unit. A printer prints medication and patient identifying information and prescribed administration date and time information on one of the strips for each unit as the strip is moved toward the packaging station. Gear drive and gear belt drive means and position sensing switch and motor control means coordinate the movement of the disk drive with the movement of the platens and the printer whereby each packaged unit has relevant information printed thereon. Units are packaged continuously, thereby developing a continuous strip of packages of units of one identity for a series of patients, with prescription information for each packaged unit shown on the package as prescribed and identified with the prescription information previously stored or simultaneously entered in a machine controlling computer.

20 Claims, 8 Drawing Sheets

MEDICATION PACKAGING AND DISPENSING SYSTEM

BACKGROUND OF THE INVENTION

This invention relates generally to packaging machines, and more particularly to a machine for packaging medications in unit dosage form and labeling them specific to the patient.

The concept of providing solid medications in unit dosage for oral administration is well known and widely used, particularly in institutional settings such as nursing homes or hospitals, for example. Probably the most widely used format is that in which the packaging of the medication is labeled with the name of the medication, the strength, the lot number and the expiration date. In a hospital setting, for example, such medications may be kept in bins, with a particular bin being designated for each particular medication. The person who is to administer the medications refers to a card or some other document which prescribes the medications. Then the person collects those medications from the appropriate bins and assembles them for delivery and administration to the particular patient.

Although the foregoing procedure is widely used, it has been recognized that there are significant advantages if a unit dose package will include the patient name, the day or date and hours of administration prescribed for the patient. A system intended to achieve this result has been advertised by the Travenol Laboratories. Inc. However, it involves very large and expensive equipment. The present invention is addressed to accomplishing the same objective but with considerably less size and expense.

SUMMARY OF THE INVENTION

A medication packaging and dispensing system includes a packaging machine with a medication unit feeder system and a packaging station where medication units are packaged individually in a continuous package strip using packing strip material stored in two rolls and pulled into the packaging station by a cooperating pair of pull and seal rollers. A system controlling computer stores prescription information for patients who are to receive the medication, and it causes a printer to print medication and patient identifying and prescribed administration date and time information on one of the strips as the strip is moved toward the packaging station. Gear and gear belt drive means and position sensing switch and motor control means coordinate the movement of the disk drive with the movement of the rollers and the printer whereby each packaged medication unit has relevant information printed thereon.

DESCRIPTION OF THE PREFERRED EMBODIMENT

Figure 1:
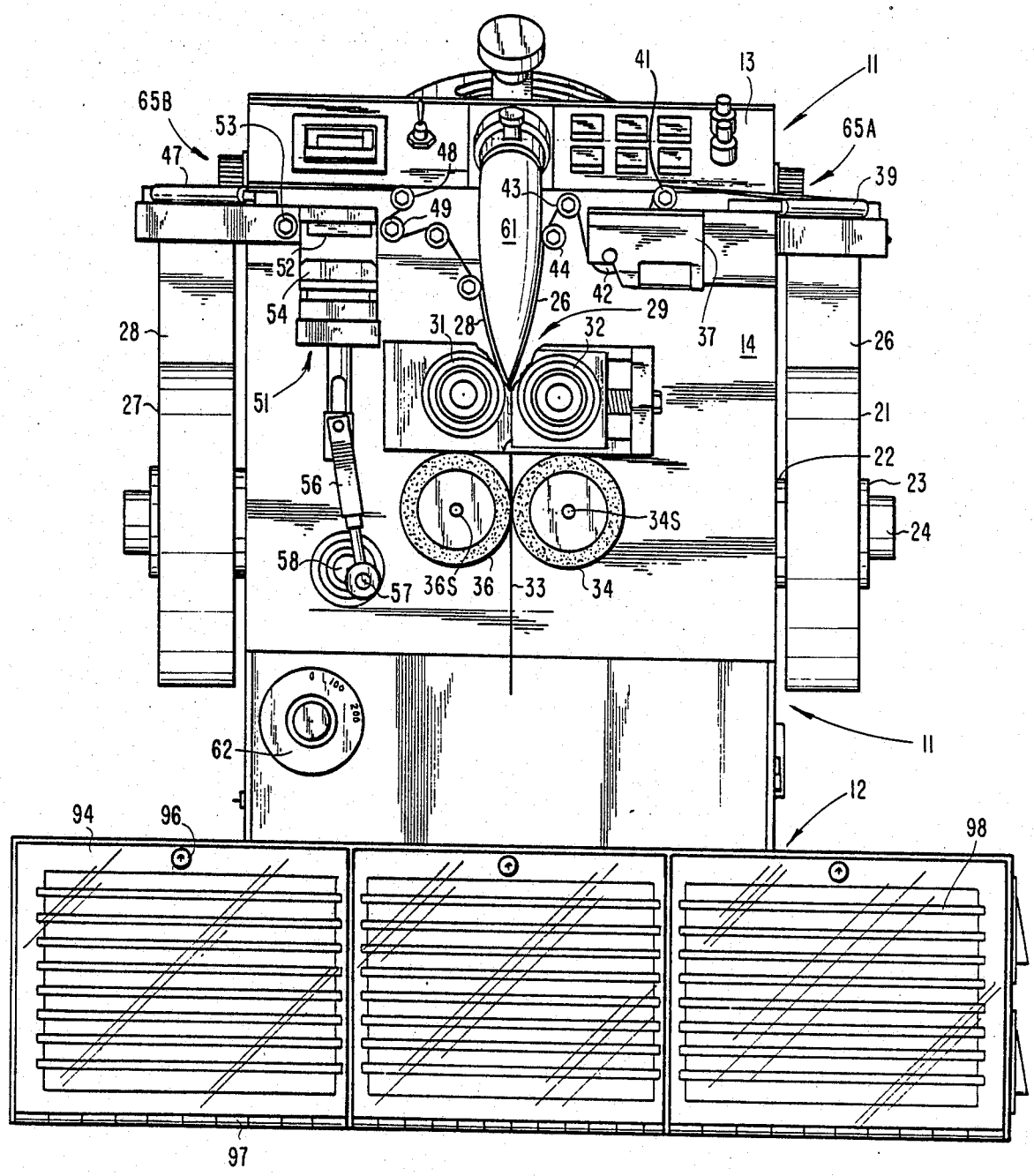
FIG. 1 is a front elevational view of a medication packaging and dispensing machine according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 6:
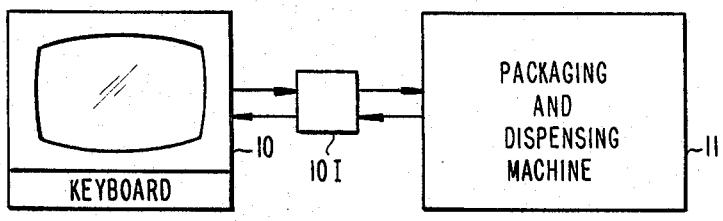
FIG. 6 is a block diagram of the system.

Referring now to the drawings in detail, the system includes a computer 10, (FIG. 6) interface 10I and a packaging and dispensing machine which includes a body 11 which may be swivel mounted on a base 12 (FIG. 1) which would be typically located on a countertop or table. The front of the body includes the control panel 13 at the top of the housing front wall panel 14. A door 16 serving as a lid covers the rear of the body, being hinged to it at 17 so that it can open outward and rearward from the top as indicated by the arrow 18 (FIG. 2) for access to the interior. A feeder bowl assembly 19 is mounted to the door. The incline of the lid is important as it serves as a base for the feeder bowl assembly. An angle of 47 degrees up from horizontal is optimum for the feeder.

Rolls of packaging material are provided at each side of the housing. Each of these rolls typically has a hollow fiberboard cylindrical core mounted on hubs at the side of the housing, and retained by a pair of flanged hubs and a knob. For example, roll 21 is mounted on flanged hubs 22 and 23 and retained by the knob 24. Roll 21 is a laminated material which typically includes a thermal paper face stock with one uncoated face laminated with polyethylene to a foil. An Appleton T1502 thermal paper face stock can be used but, where infra red readable face stock is preferred, a paper may be used such as KPT86R as marketed by Kanzaki Manufacturing Company, Ltd. of 303 South Broadway, Suite 224, Tarrytown, N.Y. 10591. The aluminum foil is provided for a moisture and vapor transmission barrier. The strip material 26 from roll 21 will be referred to hereinafter as the message strip, for convenience.

The packaging material roll 27 at the opposite side of the housing is typically a clear plastic material. It is preferably a high density polyethylene film of the monoaxial type such as furnished by the Van Leer Company of Texas. For convenience, the strip 28 from that roll will be referred to hereinafter as the transparent strip.

The two strips of packaging material are merged and sealed by a pull and seal assembly 29 which is mounted to the front housing wall 14. This assembly includes a pair of heatable cylindrical roller platens, one on each of the ball bearings 31 and 32 and which bring the strips 26 and 28 together and seal them around a medication unit (tablet, capsule, or caplet). The resulting serrated strip 33, of printed packages of encapsulated medication units, descends from the pull and seal assembly, being guided between two pairs of foam plastic rollers 34 and 36. The packaging material may be made of or coated with heat sealable material. That is why the platens are heatable. However, it is possible to use a cold-seal cohesive material on the packaging material, in which case the heating of the platens is not necessary.

A computer interfaced printer assembly 37 is mounted on wall 14. The message strip 26 passes up from the roll 21 and forward over a roller 38 (FIG. 3) under the roller 39, off the top of roller 39 to the left over the top of the roller 41 and down from there through the printer assembly 37. It moves from the discharge roller 42 thereof upward and over roller 43, down along roller 44 into the pull and seal assembly 29. Similarly, the transparent strip 28 passes up over the housing side mounted roller 46 under the angle roller 47, over roller 48, around and under roller 49 and over two additional rollers from which it enters the pull and seal assembly 29. An example of a printer assembly 37 is the Model SMS 159–448 High Speed Thermal Printhead for AIAG bar code applications, as sold by Gulton Industries, Inc., Hybrid Micro-Circuit Center, 212 Durham Avenue, Metuchen, N.J. 08840, with a UMCB-01 universal mechanism controller board.

An alternative apparatus for printing on the message strip is provided. This involves a mechanical imprinter assembly 51. It includes anvil 52 located between roller 49 and roller 53. The plate holder 54 is on a slide mounted to the housing front 14 and driven vertically by a connecting rod 56 whose lower end is connected to a crank pin 57 on a crank shaft 58 driven from inside the housing. This assembly can be used instead of the printer assembly 37 in case of a failure of the latter. Of course, in such instances, the message strip is mounted at the left-hand side of the housing, and the clear strip is mounted at the right-hand side. When the mechanical imprinter assembly 51 is used, the message strip is passed from roller 47 under roller 53 and across under the anvil 52 to the roller 49 from which it continues on around the two additional rollers and down into the pull and seal assembly. In this way, the two rollers 53 and 49 guide the message strip under the anvil for imprinting.

A product drop tube 61 is mounted to the housing and has its upper end near the top of panel 13 and its lower end between the two packaging strips 26 and 28 at the pull and seal assembly 29.

A temperature control knob and dial 62 is provided at the front of the housing to adjust the temperature of the imprinter assembly 51. The pull and seal rollers in the pull and seal assembly 29 are individually temperature controlled with knobs 65A and 65B on the left and right sides of the housing.

Figure 3:
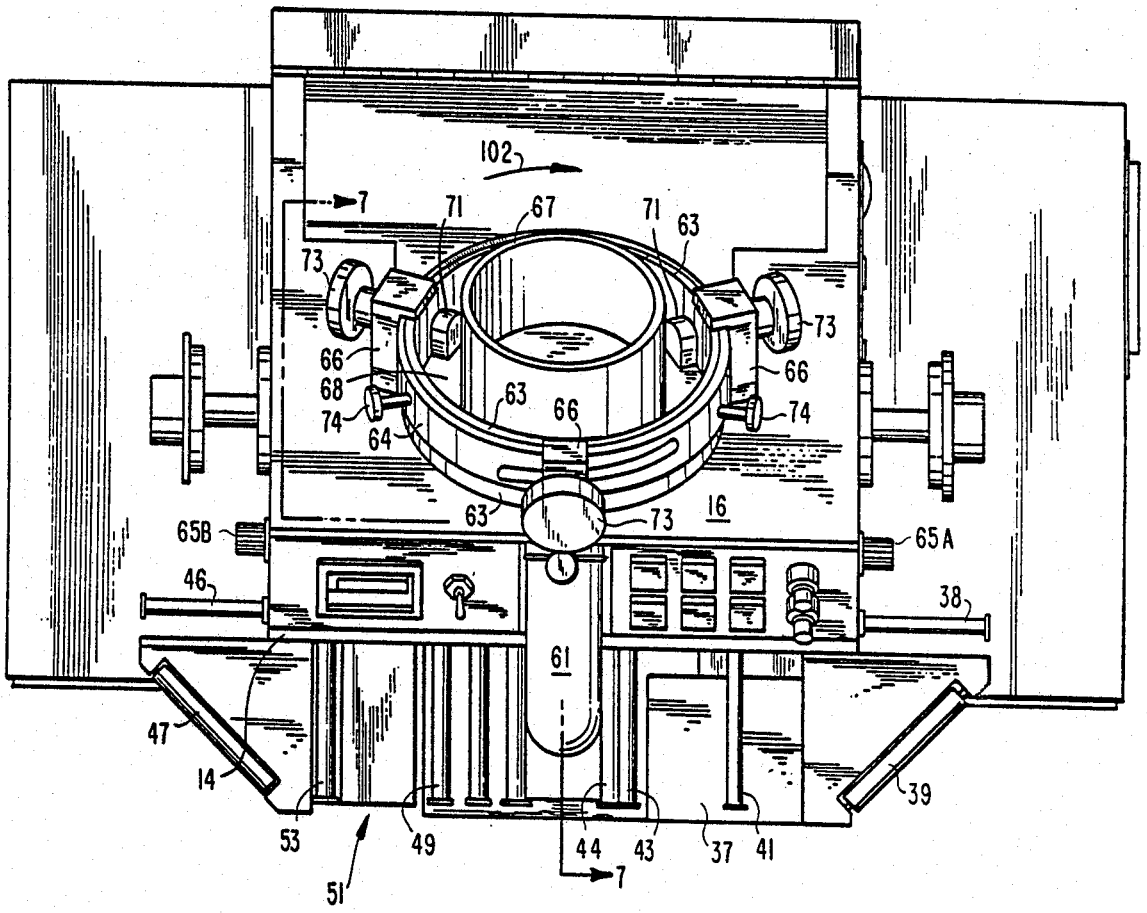
FIG. 3 is a top plan view thereof with the packaging material rolls removed.
Figure 7:
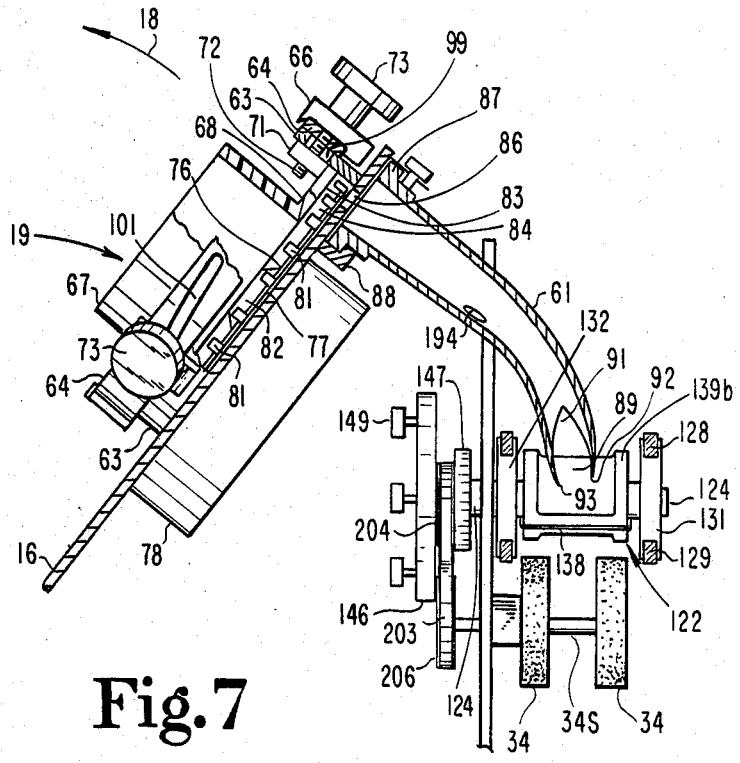
FIG. 7 is a fragmentary side elevational view, partially in section, of the medication unit feeder and sealing mechanism.

Referring now to FIG. 7, the medication unit feeder system is shown. The feeder bowl assembly includes a cylindrical base ring 63 which is fastened to the lid 16 with quick disconnect fasteners (not shown) whereby it is removable, for cleaning or the like, but is normally fixed and stationary in place. A cylindrical adjusting ring 64 is mounted on this base ring. Three clamp assemblies 66 (FIG. 3) are slidably received on this adjusting ring. 64, with the top of the "C" shaped yoke screwed to the top of base ring 63 to maintain the circular spacing of the clamp assemblies on the ring as shown in FIG. 3. The part of the top of the "C" yoke that is screw fastened to the top of ring 63 is broken away in FIG. 7 to make room for lead lines for references 63 and 64. A product receiver 67 (which serves as a reservoir wall as will be seen) has a circular flange 68 whose outer circular surface is slidably received in the base ring 63. Three bosses 71 are integral with flange 68 and extend upwardly therefrom. Each of them has a threaded aperture receiving a screw 72 fixed to the knob 73 associated with one of the clamps 66. The adjusting ring 64 has at least two posts 74 (FIG. 3) attached to it which facilitate manually turning the ring relative to the base ring 63 about the axis of the feeder assembly.

A sizing disk 76 is mounted to a drive head 77 (FIGS. 7 and 8) which is on the upper end of a shaft (not shown) extending through the lid 16 from a drive mechanism at a location shown generally in box 78 in FIG. 7. There is a center boss 82 around and receiving the disk drive head 77 in its center. The drive head is actually a nut mounted on the drive shaft and circularly oriented on the shaft for correct positioning of the disk notch 79 (FIG. 8) relative to the optical sensor 197 ferrule tip, and secured in position on the shaft by set screws. The top of the nut is generally square as is the hole in the boss on disk 76, but two opposed corners are radiused or rounded to match two opposed corners are mounting hole in the disk so that all of the disks are matched to the head and, upon installation, each disk will have the correct circular indexing relative to the drive shaft.

The disk 76 has a plurality of circularly spaced notches or spaces 79 in its outer edge. As an example, for a machine having a seven inch disk diameter, it is desirable that all disks have eighteen spaces. The size of the spaces will depend upon the size and shape of the medication unit to be dispensed. Spacer lugs 81 are provided between these notches and, as shown best at FIG. 7, extend above the top face of the disk. Medication units must be admitted between the top face of the disk 76 and the bottom face 83 of flange 68 (FIG. 7). The lugs 81 extend up to a level of about 0.032 inches below the face 83. This may be accomplished by having the height of the lugs vary from disk to disk, depending on the size and shape of the medication unit to be handled. Also, a lugless spacer disk can be mounted under any given disk to elevate the disk as may be required to obtain entry and retention of but a single medication unit into a space, and to obtain desired center of gravity stability for the medication unit as it is moved around to the outlet mentioned hereinafter. As an example, the spacer disk may be 0.062 inches thick and five inches in diameter. Accordingly, medication units, whether they be capsules, tablets or caplets, can be received in the reservoir defined by the wall of receiver 67, descend onto the disk 76, but cannot move downward into the circularly spaced notches 79 until the units are properly oriented in the distribution space 84 between the top of disk 76 and the bottom of flange 83.

A feeder outlet aperture 86 is provided in the lid 16 under the uppermost point reached by the notches 79 as the disk is turned by the drive mechanism 78.

Figure 5:
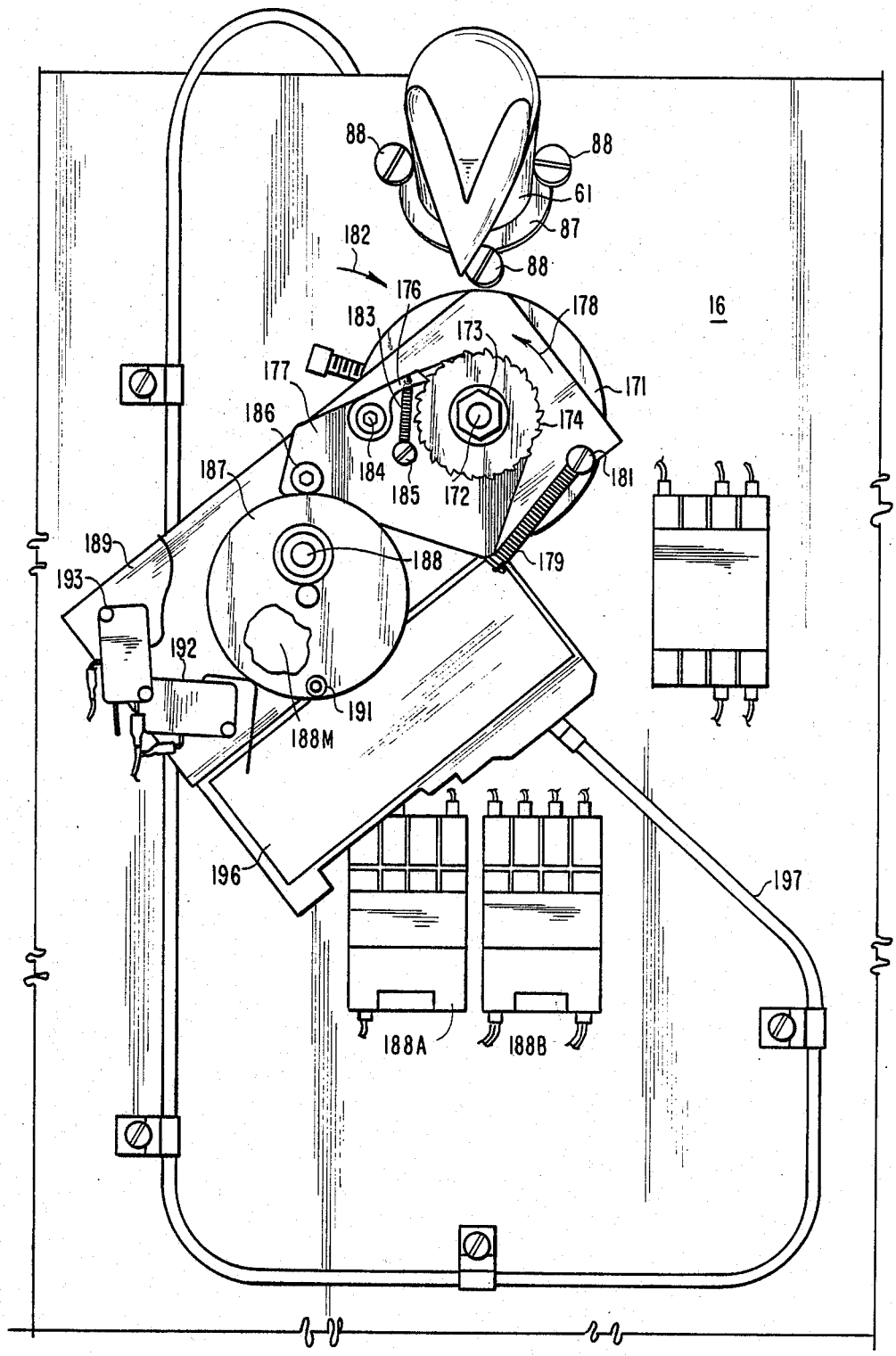
FIG. 5 is an inside view of the housing lid and showing the drive components for the feeder bowl.

The drop tube 61 is shown with a flange 87 received in a yoke unit 88 secured to the bottom of lid 16. This yoke slidably receives the flange of the drop tube to hold it in place on the lid. Unless intentionally removed from the lid, the drop tube will remain attached to the lid, even when the lid is swung back in the direction of arrow 18 (FIGS. 2 and 7) to a horizontal position for access to the interior of the housing. Although the cooperation of the flange and yoke unit is shown schematically in FIG. 7, it is actually a set of three large headed screws 88 arranged in a triangle as shown in FIG. 5 and receiving the drop tube flange 87 under the screw heads.

As shown in FIG. 7, the drop tube is shaped so that it will directly receive the units as they pass through the aperture 86, one-at a-time and will descend down the drop tube to the tube outlet 89. The notch 91 in both sides of the drop tube at the outlet end is provided to accommodate the V-shaped (FIG. 1) convergence of the two packaging films 26 and 28 as they approach the pull and seal rolls in the pull and seal assembly 29. The front and rear edges 92 and 93 of the drop tube at this location are oriented to preclude escape of the medication unit from the packaging strips at the pull and seal assembly 29. So it is that the drop tube is shaped to cooperate with the film strips to control, contain and guide the medication unit placement in each to-be-formed package.

Now that the sizing disks have been described, and referring again to FIGS. 1 and 2, it should be noted that the base 12 has three doors 94, each having a knob 96 at the top and a hinge 97 at the bottom. These are transparent plastic doors and provide access to the space inside the base and which has slotted side and rear walls as at 98, to receive an assortment of sizing disks (not shown) having different sizes and shapes of the notches such as 79 in FIG. 8, to accommodate different sizes and shapes of medication units.

In addition to differences between disks, insofar as the size and shape of notches 79 is concerned, there are also different heights of spacer lugs 81. It is desirable that the distribution space 84 will be of a height consistent with that of the lugs 81 and that the disk thickness and height relative to the top surface of the lid on which the medication units are moved around by the disk, be sufficient to prevent gravity pull "roll-out" of medication units from the notches as they near the top of their arc of movement, and also prevent "piggybacking" of the medication units in the notches. In order to accommodate the different heights, the receiver 67 can be moved axially. This is accomplished by unclamping the knobs 73, and turning the ring 64 by manually gripping the knobs 74 and turning the ring about its axis until the desired spacing between flange face 83 and disk top face 76, is obtained. The vertically extending slots such as 99 in ring 63 at each of the three locations where the knobs 73 are positioned, and the size of the screw receiving holes in the yokes of the clamp assemblies, permit the screws associated with the knobs to rise in the slots as the inclined slots 101 of the ring 64 force the screws upward axially as the ring 64 is turned by manually moving the knobs 74 in the clockwise direction of arrow 102 in FIG. 3. This will increase the height of the distribution space 84. Turning the ring in the opposite direction by manually moving the knobs 74, will reduce the height of the distribution space. When the desired spacing is obtained, the knobs 73 are tightened to clamp the ring and the associated boss 71 against the stationary cylinder 63. Scale markings with a vernier can be used on the top edges of the rings 63 and 64 to assist in establishing and repeating spacings desired for various medication units at various packaging times.

Figure 4:
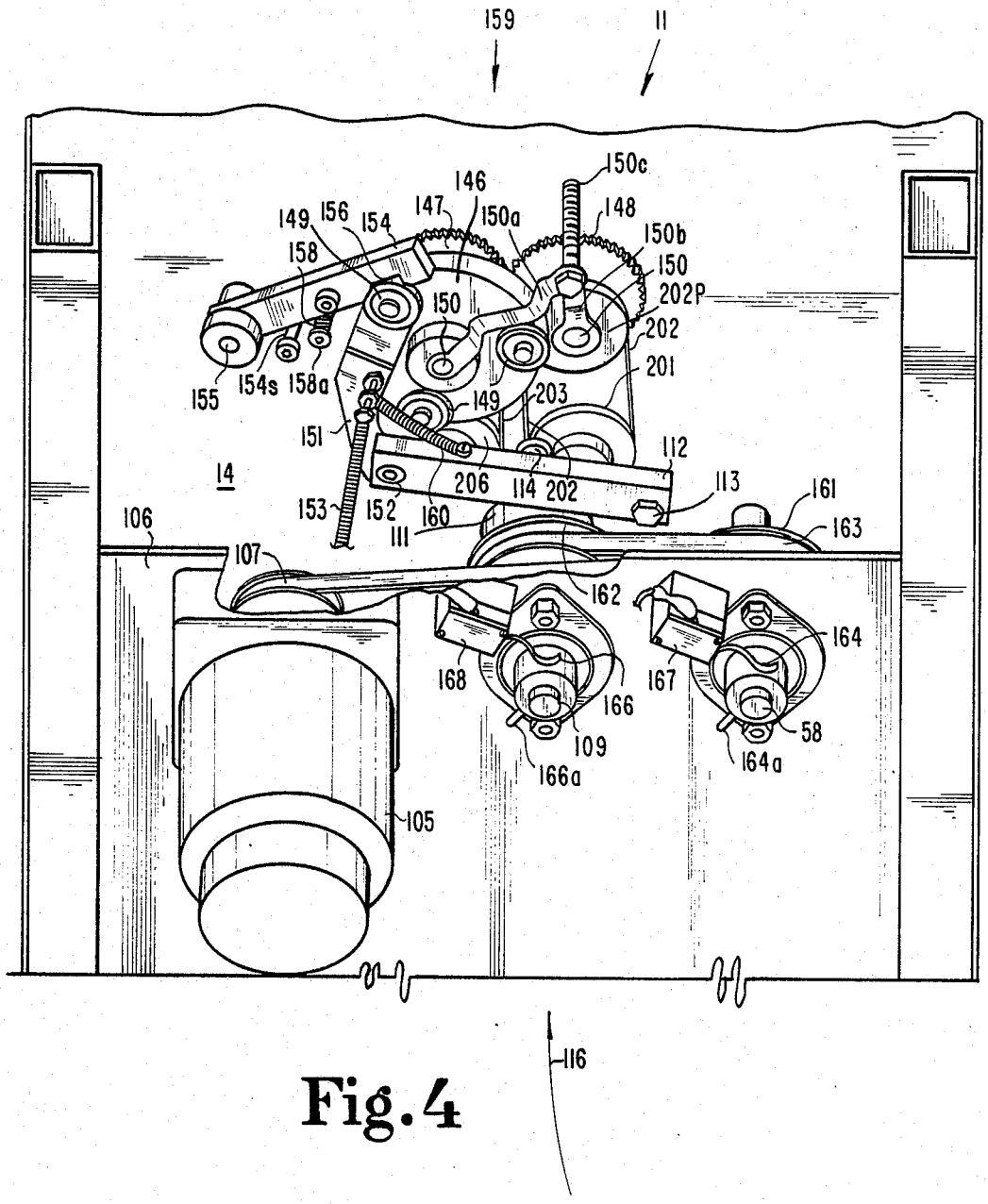
FIG. 4 is a fragmentary interior view looking in the direction of arrow 4 in FIG. 2 and showing drive components for the packaging material.

Referring now to FIG. 4, there is shown the mechanism for driving the pulling and sealing rolls and mechanical imprinter. It includes a drive motor 105 mounted on interior wall 106 in the housing 11. It has an output pulley driving a gear belt 107 which drives pulley 161 attached to crankshaft 58.

A camshaft 109 is mounted between housing walls 14 and 106. There is a cam 111 on camshaft 109. A main drive arm 112 is pivotally mounted to a post 113 fixed to the inside of the front wall 14 of the housing. It has a cam follower roller 114 engaged by cam 111 to move the arm upward in the direction of arrow 116 one time per revolution of the cam.

Figure 2:
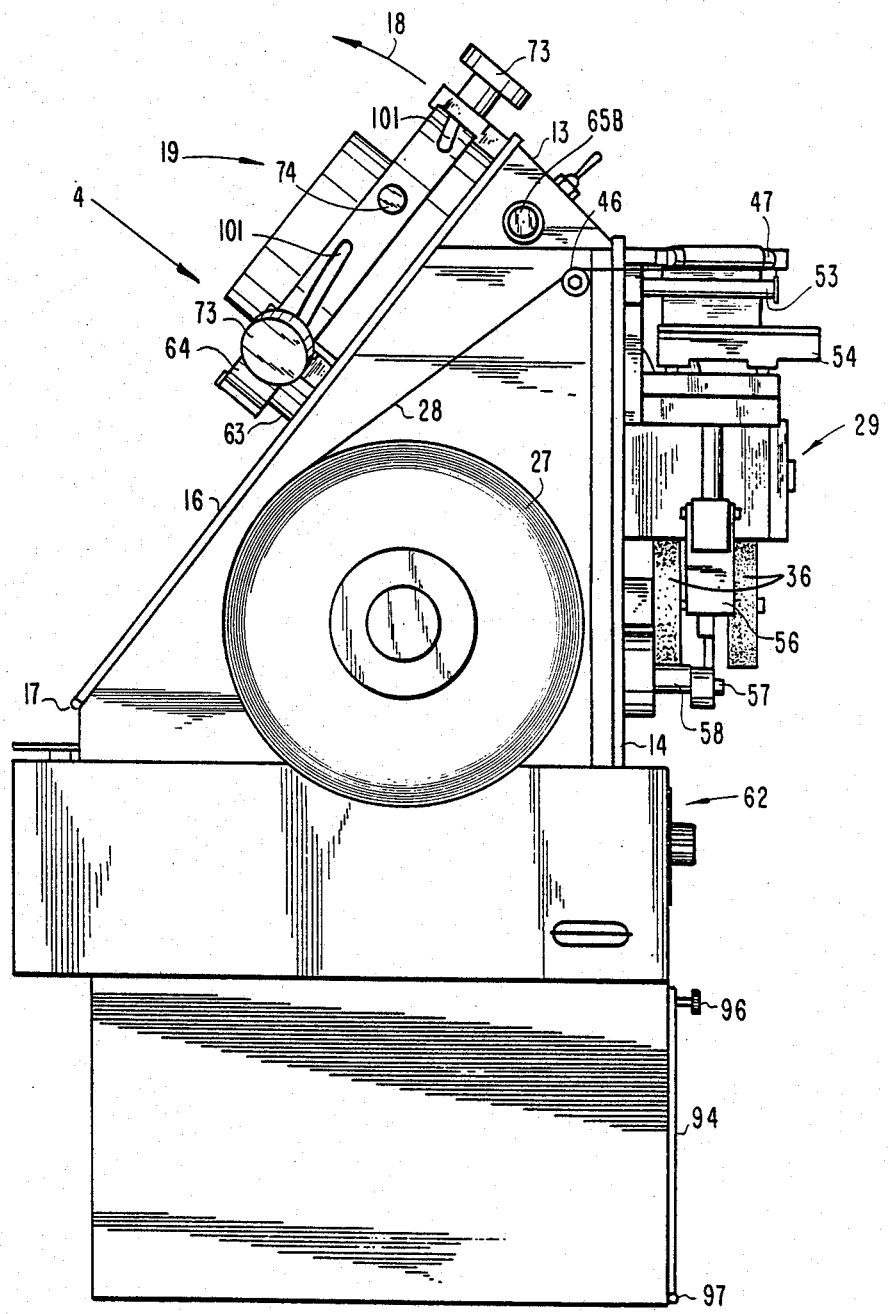
FIG. 2 is a left-hand side elevational view thereof.
Figure 9:
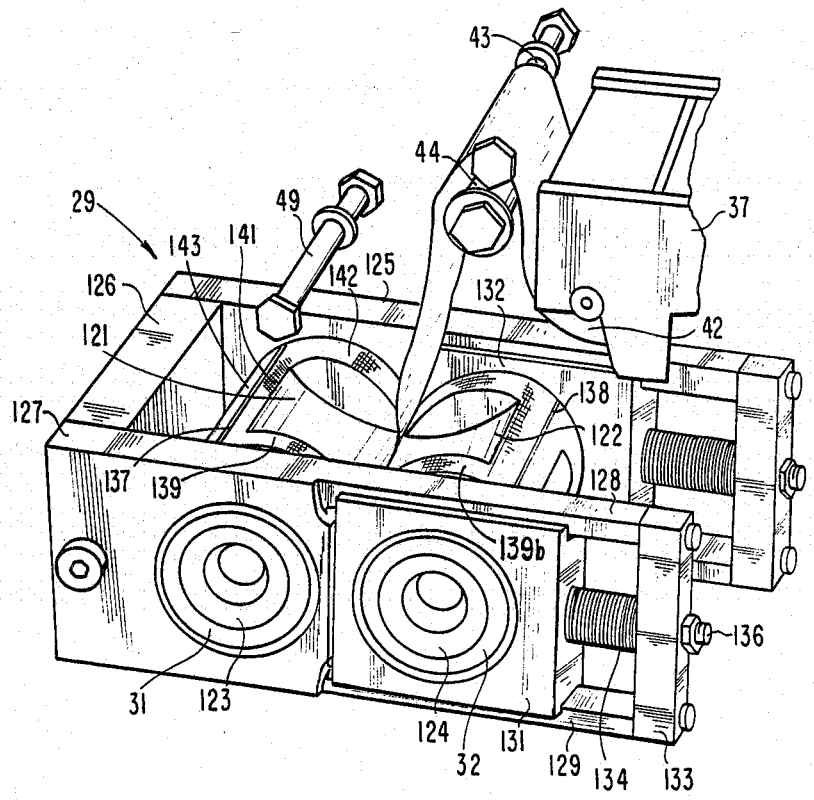
FIG. 9 is an enlarged pictorial view of the strip pull and seal assembly.

The purpose of the main drive arm will be better understood if the actual pull and seal assembly 29 is first described in some detail. Referring primarily to FIGS. 1, 7 and 9, there is a pair of rotary sealing platens 121 and 122. Each of them is mounted on a drive tube. Drive tubes are used so that platen heaters can be employed inside the tubes to heat the platens for sealing the packaging strips together at the platens. These drive tubes are mounted in a platen bearing frame assembly which includes a frame which is generally U-shaped when viewed from above. This frame includes the back plate 125 fixed to the housing front wall 14. A bridge plate 126 is rigidly attached to the back plate. Front plate 127 is rigidly attached to the bridge plate and parallel to the back plate. Each of plates 125 and 127 has a ball bearing assembly such as 31 mounted in it and which receives and supports the drive tube 123. Also, each of the plates includes a pair of parallel rails extending to the right such as the upper and lower rails 128 and 129 extending from plate 127. Each pair of rails has a bearing support slide guidingly received and supported by it. For example, the slide 131 has bottom flanges received on and guided by the bottom rail 129, and top flanges received on and guided by the top rail 128. Slide 132 is made in the same way and received on the upper and lower rails of back plate 125. Each pair of rails has a header 133 bolted to the outer ends. A Belville spring stack 134 is located on bolt 136 which is mounted in slide 131 and extends through the header 133 and urges the slide 131 to the left. Slides 131 and 132 mount ball bearing assemblies such as **131*b* in which the drive tube 124 for platen 122** is rotatably mounted.

The platens are very similar in some respects, each of them being comprised of three arcuate sectors bolted together onto the drive tube. At the periphery of the platen 121, and sandwiched between each pair of sectors, is an anvil piece such as 137. Thus, there are three equally spaced anvil pieces in the platen assembly 121. Similarly, there are three equally spaced serrating blades 138 in the serrating platen assembly 122. The peripheral surfaces of the three sectors in each of the two platens are lightly knurled. These are, for example, the locations 139, 141, and 142 of the sector at the top in the platen assembly 121 and the location 143 of the adjacent sector. The identical type of construction is provided for the three sectors in this platen and for the three sectors in platen assembly 122. The counterpart knurled cylindrical surface portions such as 139 and 139b of the platen assemblies 121 and 122 respectively are urged into engagement with each other by the Belville spring stacks, urging the bearing support slides 131 and 132 for the drive tube 124 to the left (FIG. 9). Drive for the tubes 123 and 124 is provided so that the platens move in synchronism and the blades of platen 122 engage the anvils of platen 121 for serrating the packaging strips after sealing. They are not completely severed but are serrated between adjacent packages for ease of intentional separation of the packages after completion.

The drive for drive tube 124 is provided by a drive disk 146 (FIGS. 4 and 7) attached to the tube 124 inside the housing. A drive gear 147 is also attached to this tube. It meshes with a drive gear 148 attached to tube 123. The inner ends of the drive tubes are obscured by the heater assembly inner ends 150 which are supported by the hanger straps 150*a* and 150*b* mounted to post 150*c* mounted to housing wall 14.

The drive disk 146 has three equally spaced ball bearing assemblies 149 mounted to the rear of it. These are engageable by a sealing platen drive disk actuator arm 151. This arm has a yoke at the upper end which is fittingly engageable with the outer race of each of the bearing assemblies 149. It has a lower end which is pivotally mounted at 152 to the distal end of the main drive arm 112. A main return spring 153 has its upper end fastened to the drive disk actuator arm 151. Its lower end is fastened to the inside of front wall panel 14 of body 11. A motion guide control spring 160 is also connected to the drive disk actuator arm 151. Its function is described hereinafter in connection with the description of the operation of the system.

A disk position maintenance arm 154 has one end pivotally mounted to the post 155 attached to the housing front wall 14. This arm 154 has a notch 156 in the lower face thereof engageable with any of the three bearing assemblies 149. An arm return spring 158 has its upper end connected to the arm 154 and its lower end connected to an anchor post 158*a* attached to the housing wall 14. The spring 158 urges the arm 154 downward in the direction of arrow 159 to retain the bearing assembly 149 in the notch 156 in the arm, once the bearing assembly has been pushed into that position by the actuator arm 151.

Further referring to FIG. 4, a pulley 162 is mounted to the cam shaft. It was mentioned above that gear belt 107 drives one pulley of the double pulley 161. A gear drive belt 163 operates on the other pulley of double pulley 161, and on pulley 162, whereby camshaft 109 is driven. This provides assurance of synchronism between the drive of the sealing platens and the mechanical imprinter, when the latter is in use. However, each of the shafts 58 and 109 has a collar secured to the inner end of it and which has a position indicator pin such as 164*a* and 166*a* for shafts 58 and 109 respectively. The pins are operable on operating arms 164 and 166, respectively, of a counter pulsing switch 167 for shaft 58 and a packager cycle completion switch 168 for camshaft 109.

Figure 8:
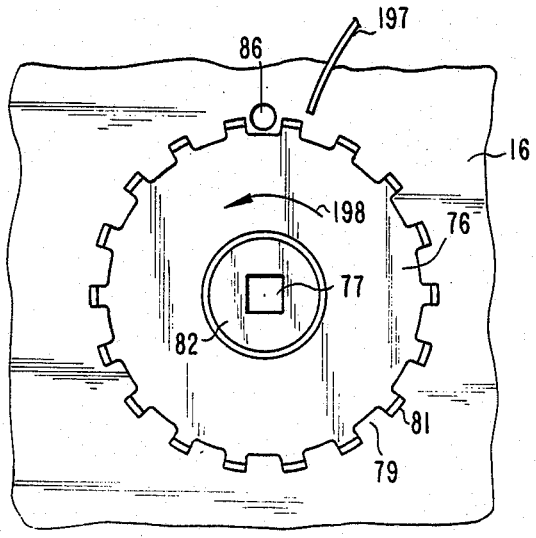
FIG. 8 is an axial view of the feeder disc, on a scale slightly larger than FIG. 7.

With reference to the medication unit feeder assembly, it has been mentioned that the sizing disk is driven by a head 77 (FIG. 8). That head is at the upper end of a shaft which passes through the lid into the drive mechanism 78 (FIG. 7). The components inside the drive mechanism are shown in FIG. 5 where a feeder drive shaft mounting block 171 is attached to the bottom of the lid 16. While the outer end of the drive shaft receives the square head 77, the inner end 172 is threaded and receives a nut 173 which attaches the ratchet wheel 174 to the shaft. The ratchet wheel is pinned to the shaft to avoid relative rotation between them.

A ratchet drive dog 176 is pivotally mounted to a plate 177 rotatably mounted to shaft 172. This plate is biased in the direction of arrow 178 by a spring 179, having one end attached to the post 181, attached to the mounting block 171. The pawl is biased in the direction of arrow 182 by a spring 183, one end of which is attached to the pawl between the pivot post 184 and the ratchet wheel engaging end, and the other end of the spring is attached to the plate 177 at anchor post 185.

Plate 177 has a cam follower roller 186 which rides on the cam 187 which is a disk eccentrically mounted on a shaft 188. A portion of the cam 187 is broken out to show the feeder drive motor assembly 188M for the shaft 188 and which is mounted under the plate 189, which is fastened to the top of the mounting block 171. A feeder drive motor on/off relay 188A, and a feeder drive motor timing relay 188B are attached to the underside of the lid 16 below the feeder drive motor and are wired to the drive motor. Cam 187 has a post 191 mounted to it for actuation of switch 193. The edge of the cam actuates switch 192, which is coupled to a fiber optics system to detect whether or not a medication unit is in one of the distributor notches immediately ahead of the outlet 86. In this way, operation of the motor 105 can be stopped until a medication unit is placed in the drop tube by the distributor sizing disc for descent through the tube as at 194 (FIG. 7) for packaging to assure that there are no empty packages leaving the pull and seal assembly. The fiber optic system for this purpose is in the unit 196 mounted at the edge of plate 189. As an example, this can be a "Multi-Beam" brand system using their LM3 logic block with their PBA power block and BF23S fibers. The cable at 197 extends from the unit to the location shown in FIG. 8 just ahead of the outlet 86 so that, as the feeder disk is turning in the direction of arrow 198, the optical system will detect the presence or absence of the medication in the notch at position of 197 and stop the packager machine motor 105 until a medication has been presented to the optic sensor 197, whereupon the packaging machine motor 105 can again be started.

Figure 10:
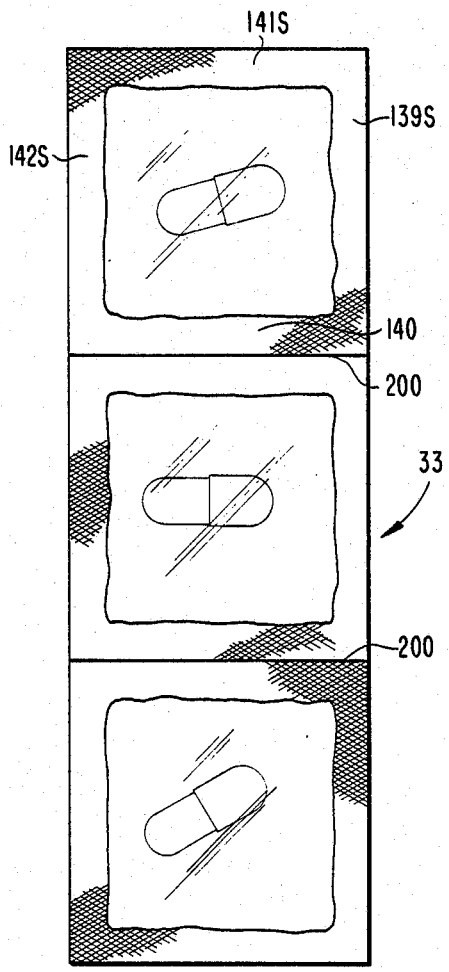
FIG. 10 is an enlarged view of one face of a strip of three unit dose packages.

Referring now to FIG. 10, there is shown a strip of three packages of medication, each having a capsule therein and completely sealed in the areas around the perimeter of the seal as at 139*s*, 140*s*, 141*s* and 142*s*, with the shading in the drawing representing the areas of the two strips sealed together by the previously described knurled surfaces of the rotary sealing platens 121 and 122, the capsule being visible through the transparent face. The serrations between packages are at lines 200.

Figure 11:
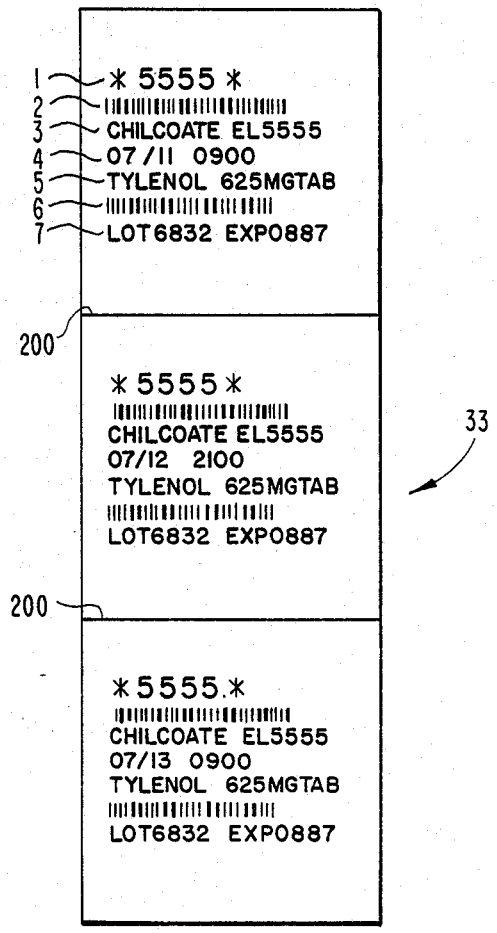
FIG. 11 is an enlarged view of the other face of a strip of three unit dose packages.

FIG. 11 is a back view of the package, each package having a maximum of seven lines of alphanumeric and bar coded information. As an example, line 1 has an identification number in large print which identifies the patient and assists in later sorting medications to patient-bins. Line 2 has the actual bar code identification for the patient. Line 3 contains the patient's name and number. Line 4 contains the date and hour of administration. Line 5 contains the name of the medication and its strength. Line 6 has the actual bar code for medication I.D. number. Line 7 has the medication lot number and expiration date and may also include the incrementing printing count such as: "00001"; "00002"; and "00003", for the first three successive packages at the beginning of a packaging operation.

In order to provide an orderly progression of the strip 33 from the bottom of the pull and seal assembly 29, and not to pinch or crush contents, two sponge surface roll assemblies 34 and 36 are used as mentioned above. Each of these is mounted to a tube. Since these are to be driven in concert with the sealing platens, the tube of each of these rolls has a pulley on it such as pulley 201 (FIG. 4) on tube 36S. It is driven by a gear belt 202 driven by a pulley 202*p* connected with gear 148 on the platen drive tube 123. An identical arrangement is provided from the drive tube 124 and gear 147 and belt 203 from pulley 204 to pulley 206 (FIG. 7) for the sponge disk assemblies 34 mounted to tube 34S. The internal space of tubes 34s and 36s slidably receive the support shafts of a wrap around OSHA safety shield (not shown).

OPERATION

In the operation of the machine, and for a first medication unit to be packaged, the information identifying the prescribed medication, name, strength, lot number and expiration date are keyed into the computer, or already stored in the computer. The relevant information regarding the patient name, number, date and time for administration of a unit, is keyed into the computer 10 by the operator. That information is stored in the computer for all of the patients who are to receive this particular medication unit.

The distribution disk appropriate for this medication unit is installed in the feeder assembly. When hermetic cold seal cohesive is not used on the packaging materials, the heaters are turned on to heat the rotary sealing platens. The proper temperature is established for the platens with dials 65A and 65B. The heater for the imprinter 51 is turned on, and the proper temperature for it is set with the dial 62 on the front of the machine.

With the packaging material rolls installed on the machine, the machine is then started and placed under control of the computer. Once started, the motor 105 runs until cycle completion switch 168 (FIG. 4), normally closed, opens to interrupt power to motor 105. Cycle switch 168 maintains power flow to a relay series which determines when the medication unit feeder drive motor may run, thus serving to synchronize the 60 RPM feeder motor 188M action with the 48 RPM action of the motor 105. Similarly the pair of relay contacts controlling these events also control a relay signal to the computer indicating the completion state of the full print-seal cycle causing the computer to initiate (but not complete) the next print command. The feeder position sensing switch 192 (FIG. 5), which is normally open, controls the "on" time of the optical sensors' logic modules and determines the selection of the point in time of the "look now" status of the optical sensor so that the unnotched (where a lug is present) portion of a feeder disk is not "seen" by the sensor tip (197, FIG. 8) and so that an object (such as a capsule) will be seen (if contained in a notched disk space 79 when in position facing the sensor tip 197 FIG. 8). The "look now" occurs when post 191 closes switch 192 (FIG. 5). The cycle switch 193 interrupts power to the medication feeder motor to provide a delay in feeder motor "on" time to allow synchronization with the slower motor 105, as does switch 168. The sizing disk is typically stepped around by the drive dog 176 at an average rate of three revolutions per minute.

Arm 151 normally rests with its upper end yoke slightly below the lowermost follower bearing assembly 149. The cam 111 is configured such that it will engage follower roller 114 and drive the main drive arm 112 upward to the position shown in FIG. 4 at the high point on the cam, one time per revolution of the cam. This will cause the upper end yoke of arm 151 to engage the lowermost bearing assembly 149 and move it to advance the cam and platen drive disk 146 upward clockwise through an arc of 120° to the position shown in FIG. 4. During this move, the knurled faces of the platens pull and sandwich the two strips of packaging material between them and seal them while doing so. Simultaneously therewith, the distributor disk of the feeder will have dropped one unit 194 of medication into the space between the strips at the platens whereupon they will seal around the complete perimeter as the platens turn. The cavities within the knurled surface frame in each of the platen sectors provide ample space for the medication to remain in the space without being in danger of crushing.

As the main drive cam 111 continues its rotation, the follower roller 114 follows the back of the cam whereupon the arm 112 will promptly descend under the urging of the spring 153. During this period, the motion guide control spring 160 connected between the arm 112 and arm 151 will control the return of arm 151 so that it will become properly positioned approximately 3/16 inches below the next one of the bearing assemblies 149 in succession on the disk 146. The position maintenance arm 154, which can be moved up by a bearing assembly 149 while arm 151 is driving upward, descends and detents the bearing assembly in notch 156, while arm 151 descends, to hold disk 146 in each index position. An arm stop post 154s prevents the arm 154 from descending far enough to cause disk 146 to back up counterclockwise. During the disk and platen idle time period of approximately 300 microseconds, while arm 151 descends, the computer will provide the thermal printer assembly 37 with appropriate information for the printing of another information block on the message strip 26 and which will eventually move into position in the feed and seal assembly.

The foregoing procedure will continue uninterrupted until the packaging of the given medication has been completed for all of the patients identified for which it has been prescribed.

For the next medication unit to be packaged, if a distributor disk with different sized notches is required, it will be installed in place of the one previously used. Appropriate information identifying this next medication is keyed into the computer and stored or called up from computer memory. The patient identification and dispensing time information are keyed in and combined with the medication information. Then the label printing and packaging is initiated again, as described above.

It is conceivable that, instead of having an adjustable feeder assembly as described herein, where the distributor disks are changed for the different medications, as is the height of the flange 68 with respect to the lid 16, to accommodate the different thicknesses of the medication units, pre-filled cassettes may be employed and simply mounted on the lid, with the drive hub engaged, and dispensing initiated as soon as the appropriate information for that particular medication and the patients to whom it is to be dispensed, is ready in the computer.

Many personal computers have the capability for driving the machine of the present invention. Where the computer is an IBM P.C. or XT or AT or a compatible, a model DASCON-1 analog and digital I/O interface board, and model ERA-01 electromechanical eight-channel SPDT relay output accessory board, both by MetraByte Corporation of Taunton Mass., may be used for interfacing at 101 (FIG. 1) with the packaging machine of the present invention. Suitable programming for the operation of the machine in the light of the present disclosure can be accomplished within the skill of the art, so a detailed description thereof is not needed here. Additional information can be printed, as desired, such as patient ward and room location, and medication bin number.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. Apparatus for packaging and dispensing medication units for unit-dosage administration to patients, said apparatus comprising:

a machine body;

a packaging station on said body;

a reservoir for holding a quantity of identical medication units;

a feeder means on said body and coupled to said reservoir to deliver medication units individually from said reservoir to said packaging station;

packaging material supply means to supply packaging material in two media to said packaging station;

merging means at the packaging station and merging portions of the two media together around said medication units at the packaging station and sealing portions of the two media together around said units to thereby individually package said units; and marking means by the path of travel of one medium of said media, and marking said one medium with patient identification and medication sortation and administration information at spaced locations on said one medium for each individual package of medication unit;

said feeder means and merging means being arranged to place identical medication units in a plurality of said individual packages in continuous succession in the merged media.

2. The apparatus of claim 1 wherein:

said marking means are by the said path at a location between said supply means and said packaging station.

3. The apparatus of claim 2 wherein said marking means include:

a printer having means therein for bar code marking identification of patient and medication on said one medium.

4. The apparatus of claim 1 and further comprising:

computer means coupled to said merging means and to said marking means for determining the location and content of said information marked on said one medium.

5. The apparatus of claim 4 wherein:

said administration information includes the date and the time when the medication unit is to be administered to the identified patient.

6. A method of dispensing medications in unit dosage form comprising the steps of:

marking medication packaging material in a continuous strip with successive discrete information blocks on the strip, each block having therein the identification of the medication unit, its strength, lot number, expiration date, identification of patient for whom it is prescribed, the date and time prescribed for administration to the patient, and bar code identification of the medication;

enclosing the medication units with the strip, each successive medication unit being confined to a different one of said blocks on the strip whereby the medication identification is visibly associated with the medication unit; and enclosing in each block of a series of blocks on the strip, a medication unit identical to the medication unit in the next preceding block and next succeeding block on the strip.

7. The method of claim 6 and further comprising the steps of:

marking successive blocks with successive administration time information for a given patient, and then commencing the marking of a next series of blocks with patient identification information and administration date and time information for another patient to receive the same medication.

8. The method of claim 7 and further comprising the steps of:

merging a strip of transparent material with the first mentioned strip and sealing the strips together around the perimeter of each block to encapsulate the medication units between the strips within the blocks.

9. A medication packaging and dispensing machine comprising:

a body:

a feeder bowl coupled to said body;

a sizing disk in said feeder bowl to receive medication units from said bowl and carry them individually to a discharge outlet;

a product drop tube having an inlet associated with said outlet to receive said units and guide them individually to a packaging station;

a disk indexing and driving hub receiving said disk on said hub;

packaging material strips;

pulling and sealing rollers at said packaging station and engaging said packaging strips and moving said strips around said medication units at said packaging station and sealing said strips together perimetrically around said units individually in said strips to form a strip of packages of said units;

printer means printing identifying information on one of said strips as said one strip is moved toward said packaging station;

coordinating means for coordinating the movement of said disk driving hub with the movement of said rollers and printing by said printer whereby each packaged medication unit has relevant information printed thereon and successive packages on the strip of packages contain identical medication units.

10. The machine of claim 9 wherein said coordinating means include:

a first drive motor;

a first cam coupled to said first drive motor;

a main drive arm operable by said cam;

a sealing roller drive cam actuator coupled to said main drive arm and operable by said main drive arm; and sealing roller drive cam wheel means rotatable incrementally by said actuator upon operation by said main drive arm in response to said first cam.

11. The machine of claim 10 and further comprising:

ratchet means coupled to said driving hub and including a ratchet wheel connected to said hub, and a ratchet driving lug operable on said ratchet wheel to provide incremental drive of said sizing disk;

said coordinating means further including:

switch means operating in synchronism with said drive arm to energize said disk drive ratchet operating lug to advance the disk to move medication units to said outlet in synchronism with drive of said sealing rollers.

12. The machine of claim 9 and further comprising:

computer means coupled to said printing means and synchronized with said printing means to print on said packaging strip for each medication unit, the name of the patient for whom intended.

13. The machine of claim 12 wherein:

said computer means is programmed to include, with the patient name, the time and location when the medication unit is to be administered.

14. The machine of claim 13 wherein:

said computer means is programmed to include, with the patient name, a different administration time printed on each of a plurality of said successive packages of individual medication units for a multi-day period of administration of the medication units.

15. The machine of claim 9 wherein said feeder bowl includes:

a base ring attached to said body and having an inner wall;

a reservoir member received in said base ring and having a radially extending circular flange with an outer peripheral edge adjacent the inner wall of said base ring, and having a lower face extending inward from said edge to an upwardly opening central cylinder for receiving unpackaged medication units in bulk form;

an adjusting ring mounted to said base ring; and clamp means associated with said base ring, said adjusting ring and said reservoir member to enable fixing said reservoir member in any of several axial positions on said base ring to establish several different fixed spacings of said reservoir flange with respect to said body.

16. The machine of claim 15 wherein:

said disk has a plurality of circularly spaced notches in the periphery thereof adjacent said inner wall of said base ring, and said disk is located between said body and said lower face of said reservoir member flange, the said spacing between said flange and said body determining the depth of a distribution space between an upper surface of said disk and said lower face of said flange to control distribution of said medication units to said notches in said disk.

17. The machine of claim 16 wherein:

said adjusting ring has cam grooves therein associated with said clamp means whereby rotation of said adjusting ring on said base ring while said clamp means are loose, moves said reservoir member axially relative to said base ring and thereby changes the said spacing.

18. The machine of claim 16 wherein:

said feeder bowl is mounted on said body at an angle with respect to horizontal, and said upper surface of said sizing disk is a planar surface disposed at an angle of about forty seven degrees up from horizontal.

19. The machine of claim 9 wherein:

said rollers include first and second rotary platens;

said first platen including sectors secured together with anvil means sandwiched between the sectors at the periphery of the sectors;

said second platen including sectors secured together with serrating blade means sandwiched between the second platen sectors at the periphery of the second platen sectors;

said first and second platens being synchronized so that the blade means of said second platen cooperate with the anvil means of said first platen as said platens are rotated to merge and seal said two strips of packaging material together around said medication units, and thereby make serrations in the merged strips between successive medication units so that a single medication unit is sealed in each package and there are serrations between successive packages.

20. The machine of claim 19 and further comprising:

platen support bearing means on said body, said bearing means including bearings for said first platen and including bearings for said second platen and including bearing support slide means for said bearings for said second platen, with said slide means resiliently urged toward said first platen to urge said second platen toward said first platen and against packaging material strips sandwiched between said first platen and said second platen.

* * * * *